US011045380B2

(12) United States Patent
Keena et al.

(10) Patent No.: US 11,045,380 B2
(45) Date of Patent: Jun. 29, 2021

(54) PORTABLE APPARATUS FOR DECOMPRESSING LUMBAR SPINE WITH LOCALIZED TRACTION

(71) Applicants: Christine Keena, Royal Oak, MI (US); Kenan Wollborg, Dearborn, MI (US)

(72) Inventors: Christine Keena, Royal Oak, MI (US); Kenan Wollborg, Dearborn, MI (US)

(73) Assignee: Christine Keena, Royal Oak, MI (US)

( * ) Notice: Subject to any disclaimer, the term of this patent is extended or adjusted under 35 U.S.C. 154(b) by 704 days.

(21) Appl. No.: 15/829,605

(22) Filed: Dec. 1, 2017

(65) Prior Publication Data

US 2019/0167505 A1 Jun. 6, 2019

(51) Int. Cl.
*A61H 1/02* (2006.01)
*A61H 1/00* (2006.01)

(52) U.S. Cl.
CPC ..... *A61H 1/0292* (2013.01); *A61H 1/00* (2013.01); *A61H 1/0218* (2013.01); *A61H 2201/0138* (2013.01); *A61H 2201/0142* (2013.01); *A61H 2201/0157* (2013.01); *A61H 2201/0161* (2013.01); *A61H 2201/0192* (2013.01); *A61H 2201/1642* (2013.01); *A61H 2203/0443* (2013.01); *A61H 2205/081* (2013.01)

(58) Field of Classification Search
CPC ..... A61H 1/00; A61H 1/02; A61H 1/0218; A61H 1/0222; A61H 1/0229; A61H 1/0237; A61H 1/0292; A61H 2201/0138; A61H 2201/0142; A61H 2201/0157; A61H 2201/0161; A61H 2201/0192; A61H 2201/1642; A61H 2203/0443; A61H 2205/081
USPC ..... 602/18, 19, 32
See application file for complete search history.

(56) References Cited

U.S. PATENT DOCUMENTS

| | | | | |
|---|---|---|---|---|
| 4,531,514 | A | 7/1985 | McDonald et al. | |
| 5,052,378 | A | 10/1991 | Chitwood | |
| 8,764,617 | B2 | 7/2014 | Teeter | |
| 9,238,157 | B2 | 1/2016 | Chuang et al. | |
| 9,358,174 | B1 * | 6/2016 | Gallo | A61H 1/0292 |
| 9,358,424 | B1 | 6/2016 | Childress | |
| 9,764,188 | B1 * | 9/2017 | Aganyan | A61H 1/0229 |
| 2010/0022368 | A1 | 1/2010 | Fernandez et al. | |
| 2015/0313784 | A1 * | 11/2015 | Evans | A61H 1/0229 602/36 |

* cited by examiner

*Primary Examiner* — Keri J Nelson
(74) *Attorney, Agent, or Firm* — Brooks Kushman P.C.

(57) ABSTRACT

A lightweight and portable apparatus that decompresses lumbar spine with localized traction is provided. The apparatus includes a base frame. A rest support shaft has first and second ends. The rest support shaft is coupled to the base frame by the first end. A stability shaft for providing rigidity to the apparatus is coupled to the rest support shaft and the base frame. First and second leg rests are supported by the second end of the rest support shaft. The first and second leg rests are supported such that the height of the leg rests can be adjustable. A plurality of feet are coupled to the base frame. The plurality of feet support the base frame by three points of contact.

16 Claims, 6 Drawing Sheets

PORTABLE APPARATUS FOR DECOMPRESSING LUMBAR SPINE WITH LOCALIZED TRACTION

BACKGROUND

1. Field of the Invention

The present invention generally relates to an apparatus for decompressing lumbar spine with localized traction, and more specifically, wherein the apparatus is lightweight and portable.

2. Description of Related Art

A wide variety of devices has been developed for decompressing the lumbar spines of humans, such as for physical therapy and chiropractic uses. Most of these devices are large, heavy, substantially immobile, and expensive. Many of these devices are practical only when owned by clinicians and chiropractors for use in clinics. The few devices that are for home use are unwieldy and difficult to move, especially for users who are suffering from spinal discomfort. Furthermore, these devices are not suitable for use on soft or uneven surfaces, such as couches or beds, thereby requiring users to stand and/or lay on a floor or table, potentially causing discomfort and/or injury.

SUMMARY

One embodiment of a lightweight and portable apparatus that decompresses lumbar spine with localized traction is provided. The apparatus includes a base frame. A rest support shaft has first and second ends. The rest support shaft is coupled to the base frame by the first end. A stability shaft for providing rigidity to the apparatus is coupled to the rest support shaft and the base frame. First and second leg rests are supported by the second end of the rest support shaft. The first and second leg rests are supported such that the height of the leg rests can be adjustable. A plurality of feet are coupled to the base frame. The plurality of feet support the base frame by three points of contact.

Another embodiment of the lightweight and portable apparatus that decompresses lumbar spine with localized traction is provided. The apparatus includes a base frame. A rest support shaft has first and second ends. The rest support shaft is rotatably coupled to the base frame by the first end. A stability shaft for providing rigidity to the apparatus is coupled to the rest support shaft. The stability shaft is rotatably coupled to the base frame. First and second leg rests are supported by the second end of the rest support shaft. The first and second leg rests are supported such that the height of the leg rests can be adjustable. A plurality of feet are coupled to the base frame. The plurality of feet support the base frame by three points of contact. The apparatus is configured such that the rest support shaft and the stability shaft can each be rotated about the base frame such that the apparatus is compacted and has increased portability.

BRIEF DESCRIPTION OF THE DRAWINGS

Advantages of the present invention will be readily appreciated, as the same becomes better understood by reference to the following detailed description, when considered in connection with the accompanying drawings.

DETAILED DESCRIPTION

Referring to the Figures, wherein like numerals indicate like or corresponding parts throughout several views, aspects of an apparatus 10 are provided.

Figure 1:
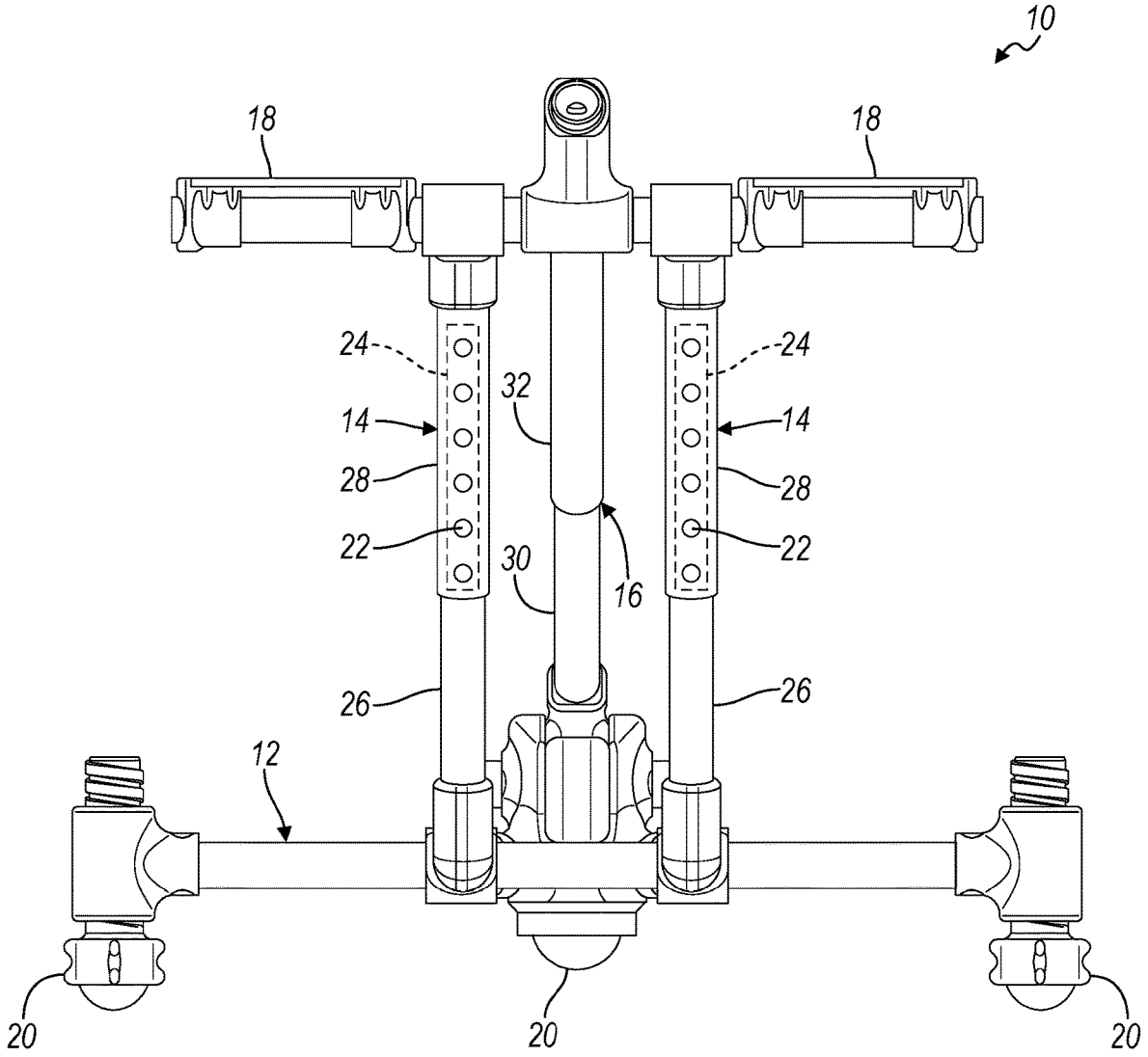
FIG. 1 illustrates a plan view of an embodiment of the apparatus in an unfolded position.
Figure 2:
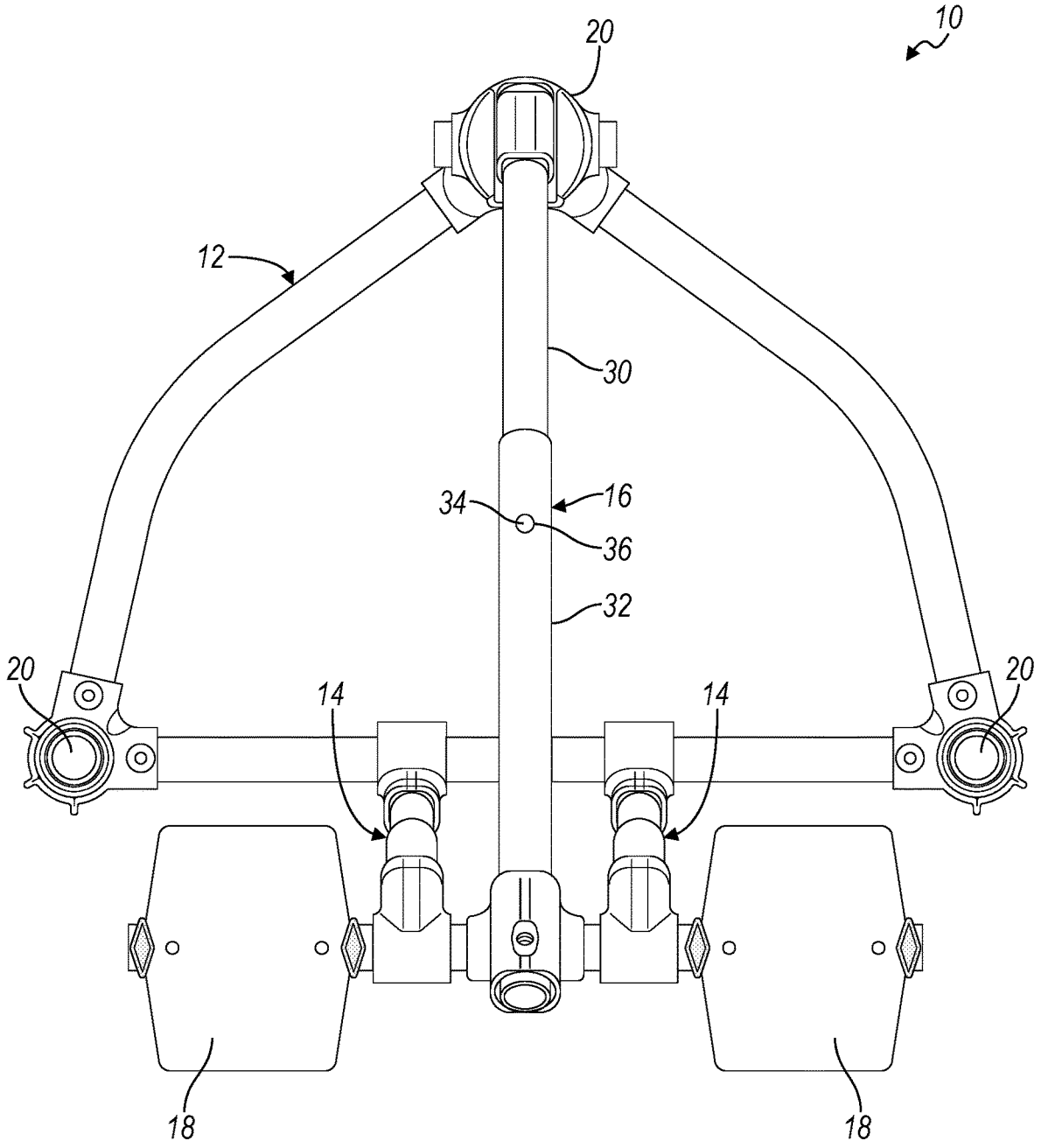
FIG. 2 illustrates another plan view of the apparatus in an unfolded position.
Figure 3:
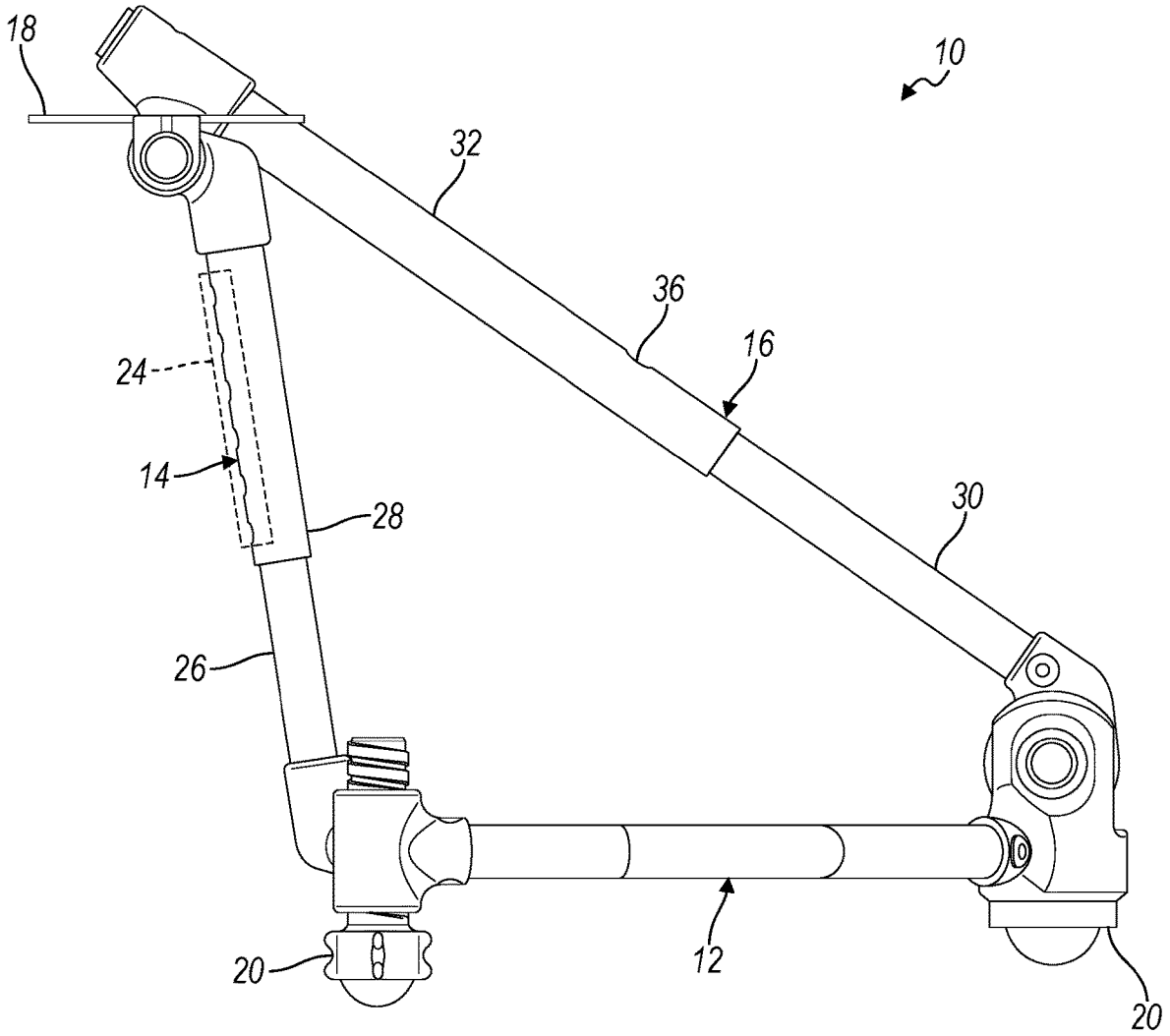
FIG. 3 illustrates yet another plan view of the apparatus in an unfolded position.
Figure 4:
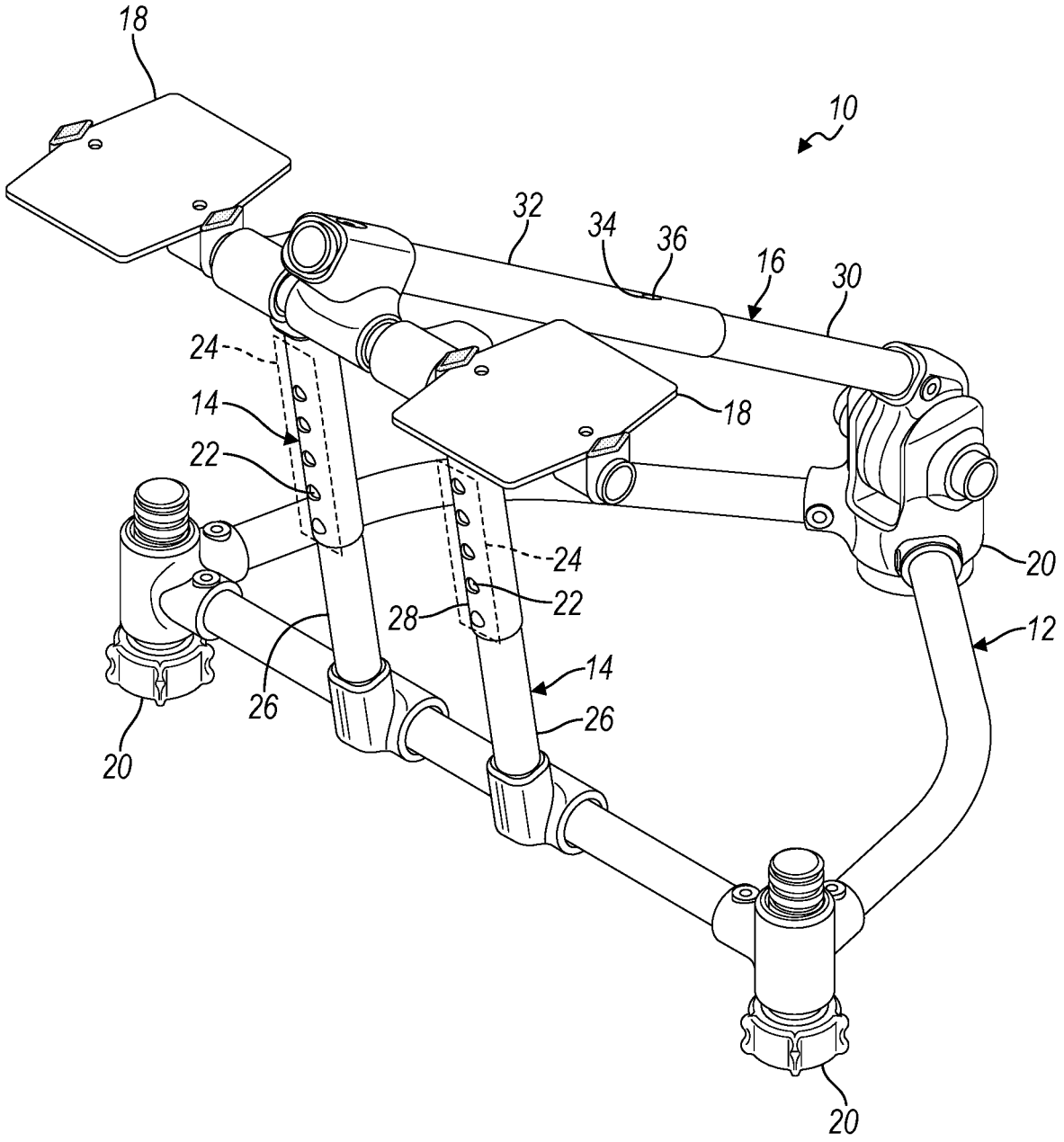
FIG. 4 illustrates still another plan view of the apparatus in an unfolded position.

As shown in FIGS. 1-4, the apparatus 10 includes a base frame 12, one or more rest support shafts 14, a stability shaft 16, first and second leg rests 18, and a plurality of feet 20. The base frame 12 is substantially rigid and configured to support the apparatus 10. The base frame 12 is substantially composed of lightweight material, such as aluminum or lightweight metal alloy. The base frame 12 can also be composed of polymeric material, or any other suitable lightweight material. In some embodiments, the base frame 12 is substantially composed of several lightweight materials.

The one or more rest support shafts 14 are coupled to and extends from the base frame 12. In some embodiments, such as those illustrated in FIGS. 1-4, the apparatus 10 includes a plurality of rest support shafts 14, the plurality of rest support shafts 14 being parallel to one another. In other embodiments, the apparatus 10 includes a single rest support shaft 14. The rest support shafts 14 are composed of lightweight material, such as aluminum, lightweight metal alloy, polymeric material, or a combination thereof. The rest support shaft 14 is rotatably coupled to the base frame 12 such that the rest support shaft 14 can pivot about the base frame 12.

In some embodiments, the rest support shafts 14 each include first and second rest support shaft portions 26, 28, i.e. first and second ends, and at least one rest support shaft locking pin 22. The rest support shafts 14 each define a plurality of rest support shaft locking holes 24. The rest support shaft locking pin 22 is fixed to the first rest support shaft portion 26. The second rest support shaft portion 28 defines the plurality of rest support shaft locking holes 24. The first and second rest support shaft portions 26, 28 are configured such that the first rest support shaft portion 26 is partially within the second rest support shaft portion 28. The first rest support shaft portion 26 is configured to slide coaxially within the second rest support shaft portion 28, such as via telescoping motion. The first rest support shaft portion 26 can slide within the second rest support shaft to align the rest support shaft locking pin 22 with one of the plurality of rest support shaft locking holes 24, thereby initiating a locked position. When the locked position is initiated, the first rest support shaft portion 26 is prevented from further sliding within the second rest support shaft portion 28, thereby rigidly aligning the first and second rest support shaft portions 26, 28. The rest support shaft locking pin 22 can be manually removed from the rest support shaft locking hole 24 in which the rest support shaft locking pin 22 is aligned, thereby initiating an unlocked position. When the unlocked position is initiated, the first rest support shaft portion 26 can once again slide coaxially within the second rest support shaft portion 28. The rest support shaft locking holes 24 are configured such that length of the rest support shaft 14 can be adjusted by initiating the locked position with the rest support shaft locking pin 22 in different rest support shaft locking holes 24. For example, some rest support shaft locking holes 24 are positioned such that initiating the locked position with the rest support shaft locking pin 22 in the rest support shaft locking holes 24 will make the rest support shaft 14 relatively shorter than if the locked position were initiated with the rest support shaft locking pin 22 in other of the rest support shaft locking holes 24. Any suitable locking mechanism can be used to initiate the locked position of the first and second rest support shaft portions 26, 28 in place of or in addition to the rest support shaft locking pin 22 and rest support shaft locking holes 24, e.g. a cam lock or an expandable friction taper lock.

The stability shaft 16 extends from the base frame 12 opposite the rest support shafts 14. The stability shaft 16 is composed of lightweight material, such as aluminum, lightweight metal alloy, polymeric material, or a combination thereof. The stability shaft 16 has a first stability shaft portion 30 and a second stability shaft portion 32, i.e. first and second ends. The first stability shaft portion 30 is coupled to the base frame 12 such that the stability shaft 16 can pivot relative the base frame 12. The second stability shaft portion 32 is coupled to the second rest support shaft portion 28. The stability shaft 16 provides rigidity to the apparatus 10 by stabilizing the rest support shaft 14 relative the base frame 12. In some embodiments, the stability shaft 16 is configured to be selectively extended and retracted. The stability shaft 16 has first and second stability shaft portion 30, 32. The first stability shaft portion 30 includes a stability shaft locking pin 34. The second stability shaft portion 32 defines a stability shaft locking hole 36. The first stability shaft portion 30 is partially slidable within the second stability shaft portion 32 such that the first stability shaft portion 30 moves coaxially relative the second stability shaft portion 32, such as by telescoping motion. The stability shaft locking pin 34 can be selectively aligned with the stability shaft locking hole 36 to temporarily prevent the first stability shaft portion 30 from sliding within the second stability shaft portion 32, thereby providing rigidity to the stability shaft 16. Any suitable locking mechanism can be used to prevent the first stability shaft portion 30 from sliding within the second stability shaft portion 32 in place of or in addition to the stability shaft locking pin 34 and the stability shaft locking hole 36, e.g. a cam lock or an expandable friction taper lock.

The first and second leg rests 18 are coupled to and supported by one or more rest support shafts 14. The first and second leg rests 18 are coupled to the second rest support shaft portions 28 of the one or more rest support shafts 14. In embodiments where the apparatus 10 includes only one rest support shaft 14, both of the first and second leg rests 18 are coupled to the second rest support shaft portion 28 of the one rest support shaft 14. In embodiments where the apparatus 10 includes a plurality of rest support shafts 14, the first and second leg rests 18 are coupled to second rest support shaft portions 28 of different rest support shafts 14. Height of the first and second leg rests 18 can be adjusted by adjusting the length of the one or more rest support shafts 14 via the rest support shaft locking pin 22 and the plurality of rest support shaft locking holes 24. In some embodiments, the first and second leg rests 18 can each be rotated via an axis radial to the one or more rest support shafts 14. In some embodiments, the first and second leg rests 18 are padded or cushioned, such as with foam, polymer, or any suitably soft material. In some embodiments, the first and second leg rests 18 are substantially cylindrical. In other embodiments, the first and second leg rests 18 each include a substantially flat portion. The first and second leg rests 18 can be any suitable shape.

In some embodiments, the first and second leg rests 18 are configured to substantially support popliteal fossa of the human body. In other embodiments, the first and second leg rests 18 are configured to substantially support calves of the human body. A user of the apparatus 10 can rest each of his or her popliteal fossa or calves on the first and second rest support shafts 14 while lying down adjacent the apparatus 10, thereby lifting and providing traction to a lumbar spine of the user. Height of the leg rests 18 can be adjusted to suit the user by adjusting length of the one or more rest support shafts 14.

The plurality of feet 20 are coupled to the base frame 12 and support the base frame 12 by three points of contact. The plurality of feet 20 are configured to support the base frame 12 when the apparatus 10 is set upon a surface, such as a floor, a bed, or a couch. In some embodiments, the apparatus 10 includes three feet 20, each of the feet 20 supporting the base frame 12 by one point of contact. The base frame 12 being supported by three points of contact allows the apparatus 10 to maintain stability when set upon a soft surface, such as a bed or a couch. In some embodiments, the plurality of feet 20 includes a pivot foot. The pivot foot is coupled to the base frame 12 and the stability shaft 16. The pivot foot allows the stability shaft 16 to pivot relative the base frame 12. In some embodiments, height of at least one of the plurality of feet 20 is adjustable. Adjusting height of the at least one of the plurality of feet 20 enables the user to raise or lower one or more portions of the apparatus 10. For example, height of one of the feet 20 can be adjusted to stabilize the apparatus 10 when the apparatus 10 is set upon a surface that is perfectly flat. In some embodiments, one or more of the plurality of feet 20 include a helical ridge, i.e. a screw mechanism, that allows the user to adjust height of the one or more of the plurality of feet 20 by twisting the one or more of the plurality of feet 20.

Figure 5:
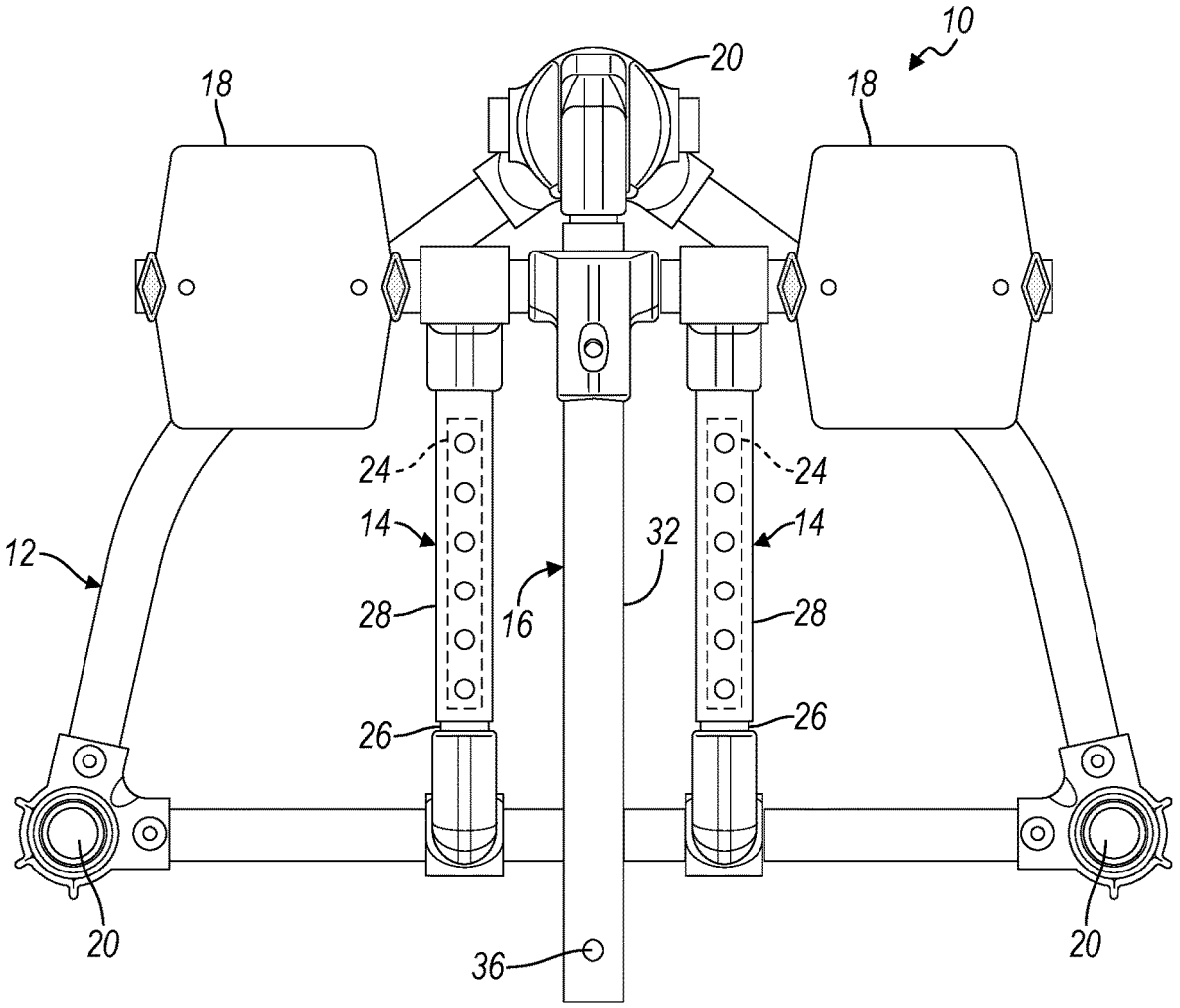
FIG. 5 illustrates a plan view of an embodiment of the apparatus in a compact position.
Figure 6:
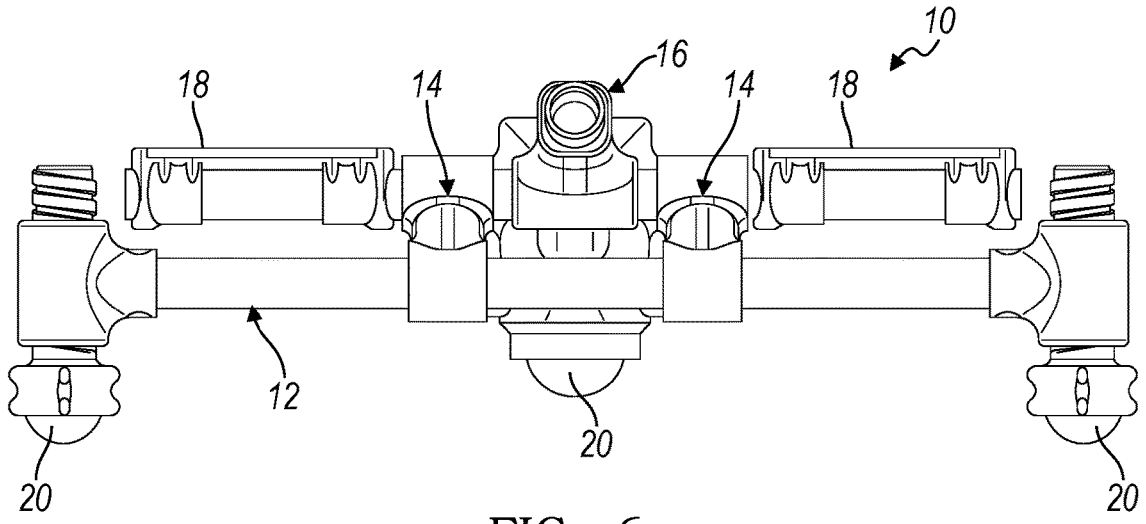
FIG. 6 illustrates another plan view of the apparatus in a compact position.
Figure 7:
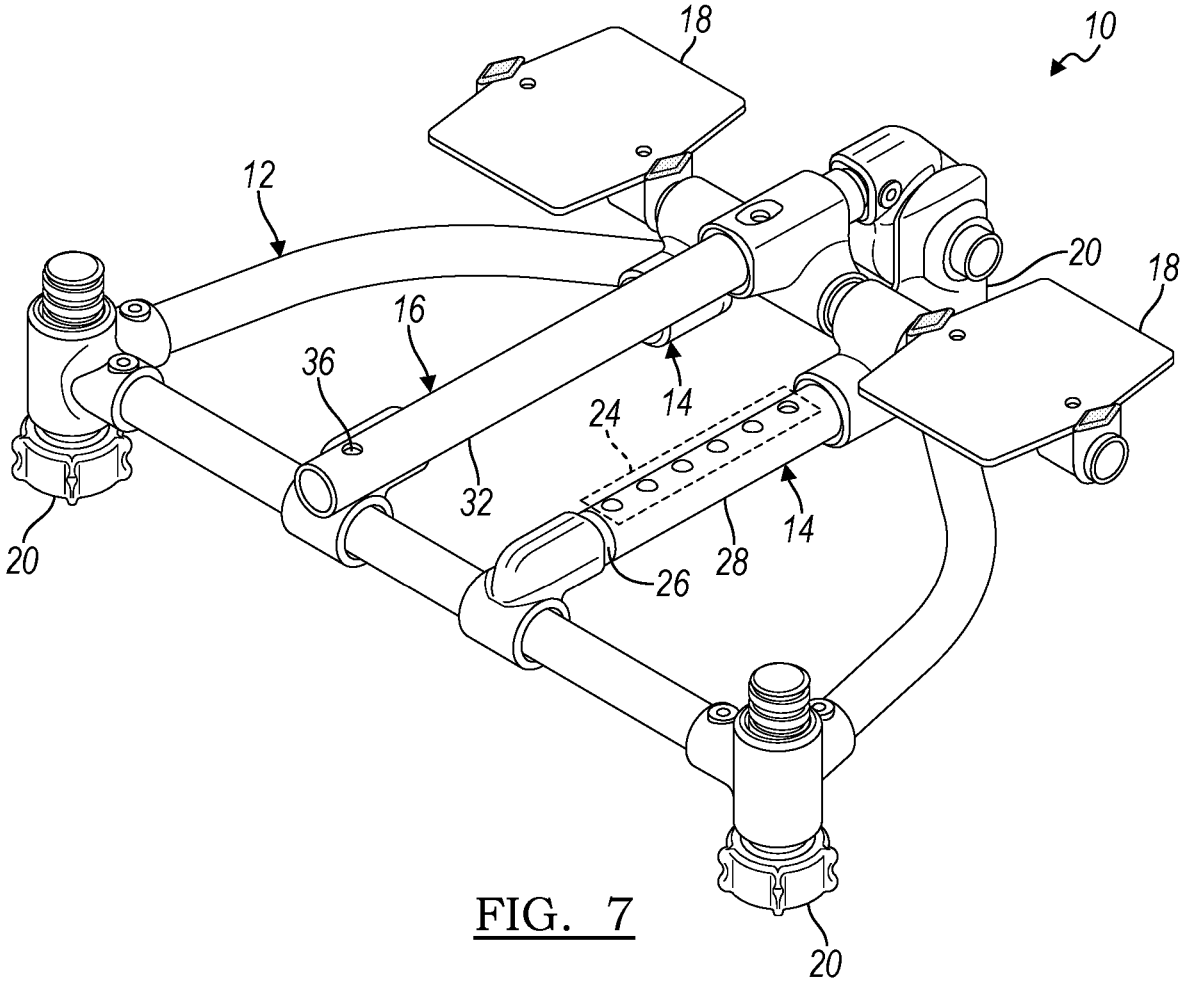
FIG. 7 illustrates yet another plan view of the apparatus in a compact position.
Figure 8:
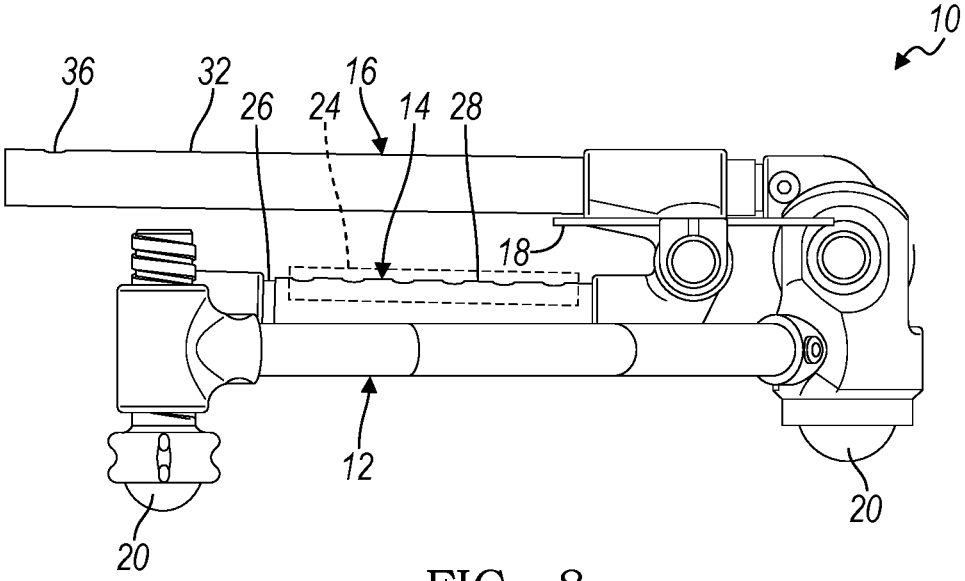
FIG. 8 illustrates still another plan view of the apparatus in a compact position.

The apparatus 10 is substantially lightweight and portable. As shown in FIGS. 5-8, in some embodiments the apparatus 10 is configured to be substantially flattened, thereby filling less volume and being portable. The apparatus 10 is configured to be substantially flattened and compacted by performing one or more of the following: shortening length of the one or more rest support shafts 14, shortening length of the stability shaft 16, shortening length of one or more of the plurality of feet 20, rotating the first and second leg rests 18, pivoting the one or more rest support shafts 14 relative the base frame 12, and pivoting the stability shaft 16 relative the base frame 12. Flattening the apparatus 10 allows the user to more easily carry and store the apparatus 10.

The present invention has been described herein in an illustrative manner. It is to be understood that the terminology which has been used is intended to be in the nature of words of description rather than of limitation. Many modifications and variations of the invention are possible in light of the above teachings. The invention may be practiced otherwise than as specifically described within the scope of the appended claims.

What is claimed is:

1. An apparatus for facilitating spinal decompression of a human body, the apparatus comprising:

a base frame;

a length adjustable rest support shaft having first and second ends and being rotatably coupled to the base frame by the first end;

a length adjustable stability shaft for providing rigidity to the apparatus, the stability shaft being coupled to the rest support shaft and rotatably coupled to the base frame;

first and second leg rests rotatably coupled to and supported by the second end of the rest support shaft such that a height of the leg rests can be adjustable; and a plurality of feet coupled to the base frame and supporting the base frame by three points of contact;

wherein the apparatus is configured such that the rest support shaft and the stability shaft can each be rotated about the base frame such that the apparatus is substantially flattened to a compact position to increase portability.

2. The apparatus of claim 1, wherein the first and second leg rests are configured to substantially support popliteal fossa of the human body.

3. The apparatus of claim 2, wherein the first and second leg rests are each substantially cylindrical.

4. The apparatus of claim 1, wherein the first and second leg rests are configured to support calves of the human body.

5. The apparatus of claim 4, wherein the first and second leg rests each include a substantially flat portion.

6. The apparatus of claim 1, wherein the height of the leg rests can be adjustable by adjusting a length of the rest support shaft.

7. The apparatus of claim 1, wherein the rest support shaft includes a locking mechanism, the rest support shaft being configured such that a length of the rest support shaft is adjustable by telescoping the rest support shaft and actuating the locking mechanism.

8. The apparatus of claim 1, wherein the stability shaft includes a locking mechanism, the stability shaft being configured such that a length of the stability shaft is adjustable by telescoping the stability shaft and actuating the locking mechanism.

9. The apparatus of claim 1, wherein the plurality of feet includes a pivot foot and the stability shaft extends from the pivot foot such that the stability shaft is pivotable about the pivot foot at the end of the rest support shaft.

10. The apparatus of claim 1, wherein the first and second leg rests are at least partially substantially round and cushioned.

11. The apparatus of claim 1, wherein the first and second leg rests are at least partially substantially flat and padded.

12. The apparatus of claim 1, wherein the height of at least one of the plurality of feet is adjustable.

13. The apparatus of claim 1, wherein the rest support shaft is further defined as a plurality of rest support shafts.

14. The apparatus of claim 13, wherein the plurality of rest support shafts is further defined as first and second rest support shafts, and wherein the first and second leg rests extend from the first and second rest support shafts, respectively.

15. The apparatus of claim 1, wherein the base frame is composed of lightweight material.

16. An apparatus for facilitating spinal decompression of a human body, the apparatus comprising:

a base frame;

length adjustable first and second rest support shafts, each of the first and second rest support shafts having first and second ends and being rotatably coupled to the base frame by the first ends;

a stability shaft for providing rigidity to the apparatus, the stability shaft being coupled to the rest support shafts and rotatably coupled to the base frame;

first and second leg rests, the first and second leg rests each being rotatably coupled to and supported by the second ends of the first and second rest support shafts respectively such that a height of the leg rests can be adjustable; and a plurality of feet coupled to the base frame and supporting the base frame by three points of contact;

wherein the apparatus is configured such that the rest support shafts and the stability shaft can each be rotated about the base frame such that the apparatus is substantially flattened to a compact position to increase portability.

* * * * *